US006789749B2

(12) United States Patent
Liu

(10) Patent No.: US 6,789,749 B2
(45) Date of Patent: Sep. 14, 2004

(54) ATOMIZER

(76) Inventor: Teh-I Liu, 12F-1, No. 295, Sec. 2, Kuang Fu Rd., Hsinchu (TW)

( * ) Notice: Subject to any disclaimer, the term of this patent is extended or adjusted under 35 U.S.C. 154(b) by 0 days.

(21) Appl. No.: 10/401,983

(22) Filed: Mar. 31, 2003

(65) Prior Publication Data

US 2003/0209614 A1 Nov. 13, 2003

(30) Foreign Application Priority Data

May 10, 2002 (TW) ..... 91109738 A

(51) Int. Cl.[7] ..... E03C 1/08

(52) U.S. Cl. ..... 239/428.5; 239/502; 239/504; 239/553.5

(58) Field of Search ..... 239/500, 504, 239/502, 419.5, 428.5, 552, 558, 557, 556, 553.5, 553, 461

(56) References Cited

U.S. PATENT DOCUMENTS 3,601,125 A * 8/1971 Moss ..... 604/347
3,742,520 A * 7/1973 Bernardi ..... 4/662
3,785,625 A * 1/1974 Engalitcheff, Jr. ..... 261/29
4,753,780 A * 6/1988 Bowen ..... 422/214
4,985,940 A * 1/1991 Jones ..... 4/301
5,027,448 A * 7/1991 Wilkins ..... 4/310
5,381,957 A * 1/1995 Bianco ..... 239/99
5,862,985 A * 1/1999 Neibrook et al. ..... 239/99
6,267,305 B1 * 7/2001 Kondo ..... 239/428.5
6,374,430 B1 * 4/2002 Ostbo ..... 4/420
6,463,658 B1 * 10/2002 Larsson ..... 29/890.142

FOREIGN PATENT DOCUMENTS

JP 07207741 A * 8/1995

* cited by examiner

*Primary Examiner*—William E. Tapolcal
*Assistant Examiner*—Mohammad M. Ali
(74) *Attorney, Agent, or Firm*—Rosenberg, Klein & Lee

(57) ABSTRACT

An atomizer includes a plenum having an open first end with a diameter greater than that of a second end of the plenum. An inlet defined in the second end of the plenum. The inlet communicates with an inner periphery of the plenum and connected to a water source. A sprayer is attached to the open first end for closing the plenum and has multiple through holes defined therein. An atomizing device is securely attached to the sprayer opposite to the plenum. The atomizing device includes multiple nozzles each co-axially aligning with a corresponding one of the multiple through holes. The nozzle includes a skirt extending from the atomizing device. Each nozzle has at least two awls laterally and radially extending from an inner periphery of each of the skirt to centrally define a passage that co-axially aligning with a corresponding one of the through hole.

5 Claims, 5 Drawing Sheets

ATOMIZER

BACKGROUND OF THE INVENTION

1. Field of the Invention

The present invention relates to an atomizer, and more particularly to an atomizer that provides an effect of water-saving.

2. Description of Related Art

A conventional atomizer in accordance with the prior art shown in FIG. 6 is adapted to be mounted on a urinal, and comprises an inlet hose (51) connected to a water source and a control valve (52) mounted on the inlet hose (51) to selectively open the inlet hose (51). An outlet hose (53) is horizontally mounted in the urinal and perpendicularly communicates with the inlet hose (51). The outlet hose (53) includes multiple apertures (54) defined in the outlet hose (53) to allow the water spray into the urinal when the valve (52) opens the inlet hose (51). The water is sprayed from the apertures (54) in the outlet hose (54) to wash the remained urine on the periphery of the urinal.

The water is formed multiple spouts after flowing out of the outlet hose (53) such that the water can not be uniformly distributed to the periphery of the urinal. Consequently, the conventional atomizer cannot provide a good cleaning effect to the urinal. Furthermore, the spreading area of the water cannot fully cover the urinal such the peculiar smell is upward spread when the multiple spouts downward sprayed from the outlet hose (53). It will make the user feel uncomfortable and wastewater.

The present invention has arisen to mitigate and/or obviate the disadvantages of the conventional atomizer.

SUMMARY OF THE INVENTION

The main objective of the present invention is to provide an improved atomizer that can fully atomize water for achieve an effect of water-saving.

To achieve the objective, the atomizer in accordance with the present invention comprises a plenum having an open first end with a diameter greater than that of a second end of the plenum. An inlet defined in the second end of the plenum. The inlet communicates with an inner periphery of the plenum and connected to a water source. A sprayer is attached to the open first end for closing the plenum and has multiple through holes defined therein. An atomizing device is securely attached to the sprayer opposite to the plenum. The atomizing device includes multiple nozzles each co-axially aligning with a corresponding one of the multiple through holes. The nozzle includes a skirt extending from the atomizing device. Each nozzle has at least two awls laterally and radially extending from an inner periphery of each of the skirt to centrally define a passage that co-axially aligning with a corresponding one of the through hole.

Further benefits and advantages of the present invention will become apparent after a careful reading of the detailed description with appropriate reference to the accompanying drawings.

DETAILED DESCRIPTION OF THE INVENTION

Figure 1:
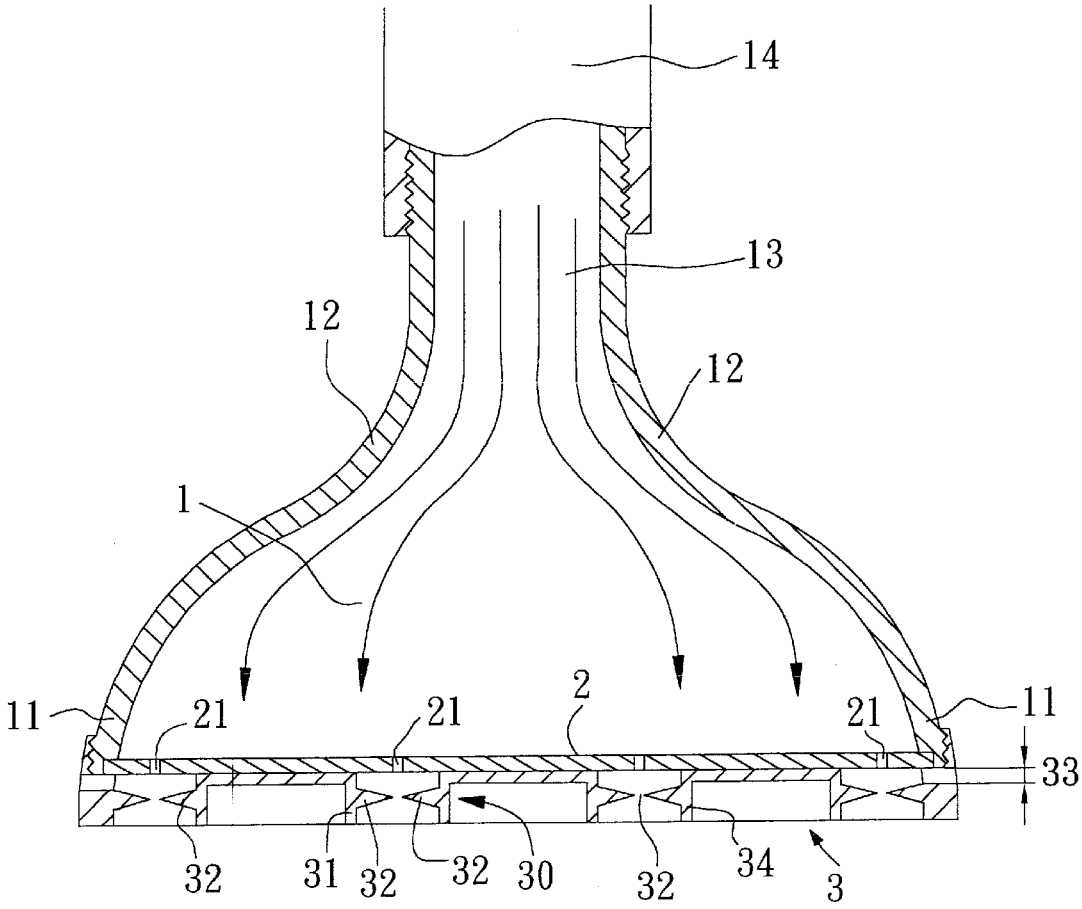
FIG. 1 is a front cross sectional view of the atomizer in accordance with the present invention.
Figure 2:
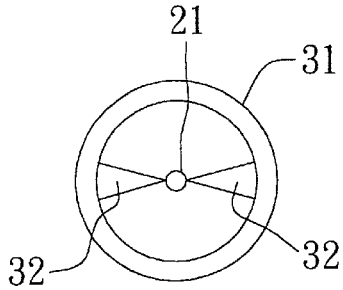
FIG. 2 is a bottom plan view of an atomizing device of the atomizer in FIG. 1.

Referring to the drawings and initially to FIGS. 1 and 2, an atomizer in accordance with the present invention comprises plenum (1), a sprayer (2) attached to a bottom of the plenum (1) and a multiple atomizing device (3) attached to the sprayer (2) opposite to the plenum (1).

The plenum (1) includes an open first end (11) and a second end (12). The first end (11) of the plenum (1) has a diameter greater than that of the second end (12) of the plenum (1). An inlet (13) is defined in the second end (12) of the plenum (1) and communicates with an inner periphery of the plenum (1). An inlet hose (14) has a first end connected to the inlet (13) and a second end connected to a water source. A valve (15) is mounted in the inlet hose (14) for selectively closing the inlet hose (14).

The sprayer (2) is a plate and attached to the open first end of the plenum (1) for closing the plenum (1). The sprayer (2) has multiple through holes (21) defined therein and communicating with the inner periphery of the plenum (1).

The atomizing device (3) is securely attached to the sprayer (2) opposite to the plenum (1). The atomizing device (3) includes multiple nozzles (30) each co-axially aligning with a corresponding one of the multiple through holes (21) in the sprayer (2). The nozzle (30) includes a skirt (31) extending from the atomizing device (3) and having an inner periphery. Each nozzle (30) has at least two awls (32) laterally and radially extending from the inner periphery of each of the skirt (31) to centrally define a passage (34). The passage (34) co-axially aligning with a corresponding one of the through hole (21) in the sprayer (2) and has a diameter smaller than that of the through hole (21) in the sprayer (2). A hole (33) is laterally defined in and extends through the skirt (31) between the awls (32) and the bottom of the sprayer (2) to allow the air flowing into the skirt (31).

As regard to the Pascal Theorem, the pressure value of liquid in a closed chamber is equal everywhere. Consequently, to provide an active force to an area in the closed chamber will get a greater reactive force relative to the active force on a smaller area relative to the area that the active force is acted. With reference to the referred embodiment of the present invention, the inlet (13) has a cross-section much greater than that of the through hole (21) and the water source provides a pressure to the inlet (13). Consequently, the water in the through hole (21) is much greater than that in the inlet (13) and the water will be sprayed from the through hole (21) in the sprayer (2) when the valve (15) is opened to make the inlet (13) communicating with the water source. The spout from the through hole (21) will be atomized when meeting the top point of the awl (32) and sprayed out of the nozzle (30) via the passage (34) because the passage (34) has a diameter smaller than that of the through hole (21).

As regard to the Bernoulli Theorem, the pressure and the flowing speed of a fluid are in an inverse ratio. Consequently, the pressure value in within the skirt (31) is smaller than that of the atmosphere such that the air will be sucked into the skirt (31) when the spout flows passing the passage (34). The sucked air will fully mixed with water in the skirt (31) and the water is fully atomized before spraying from the atomizer of the present invention. As described above, the atomizer in accordance with the present invention atomizes the water by using the pressure different in the skirt (31) and the atmosphere such that an electric power is unnecessary to the present invention.

Figure 3:
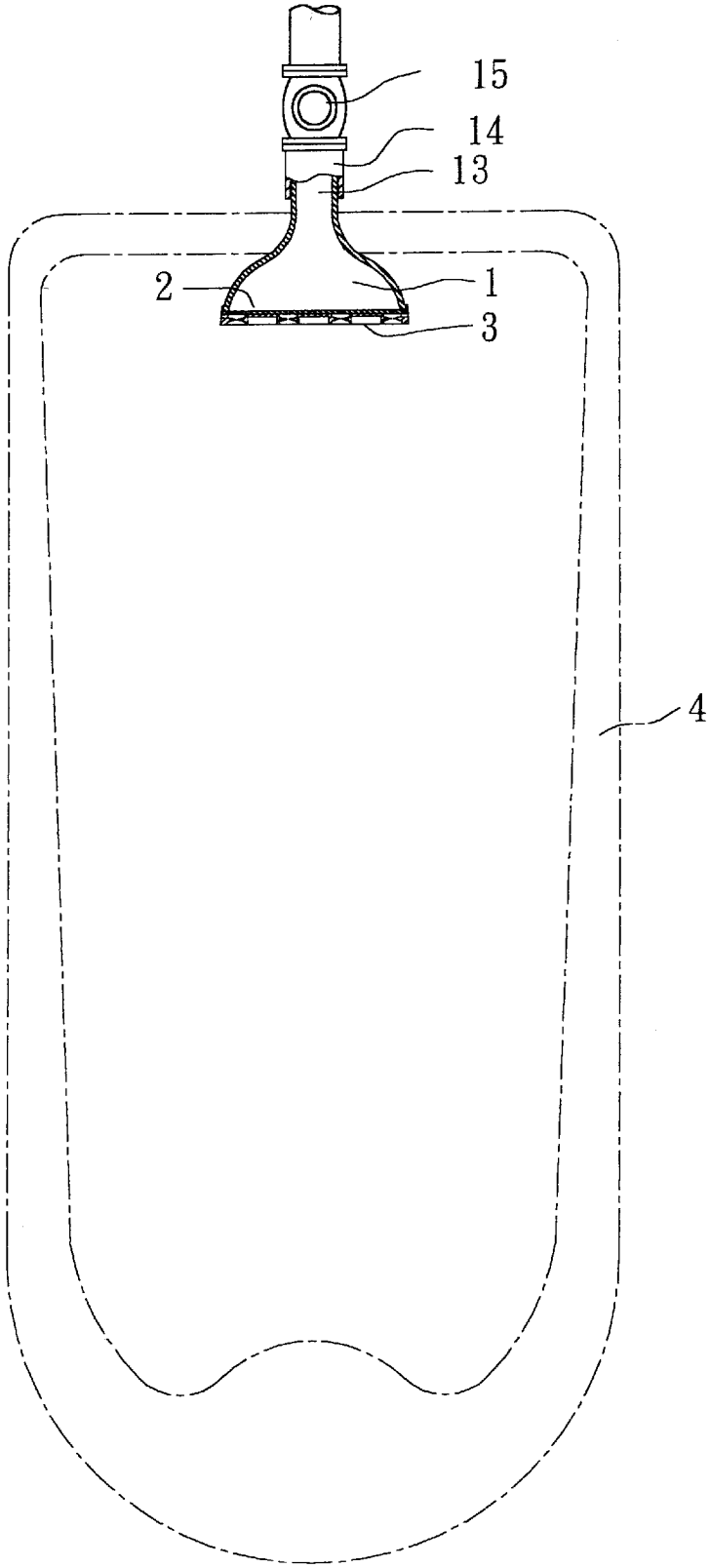
FIG. 3 is a schematic plan view of the atomizer in FIG. 1.
Figure 4:
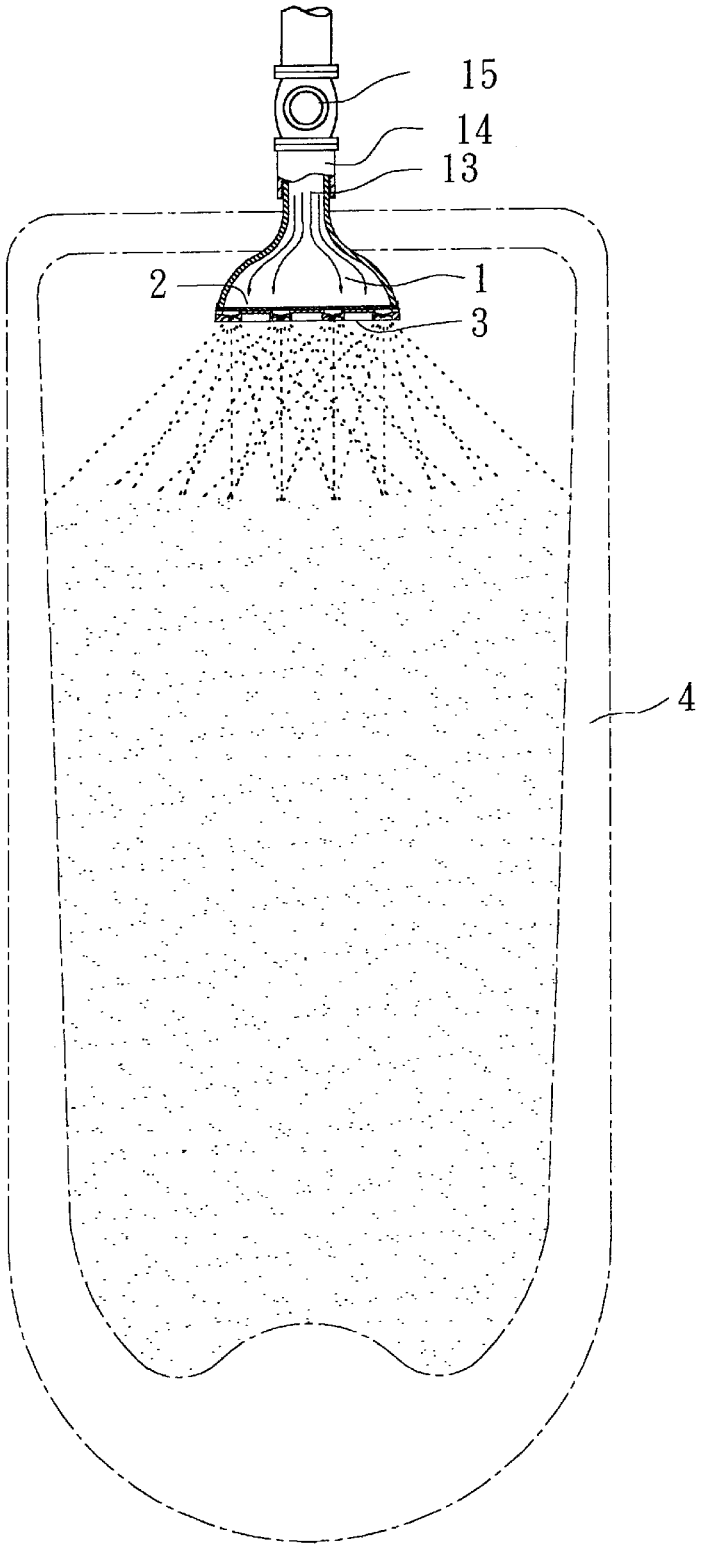
FIG. 4 is a first operational front plan view of the atomizer in FIG. 1.
Figure 5:
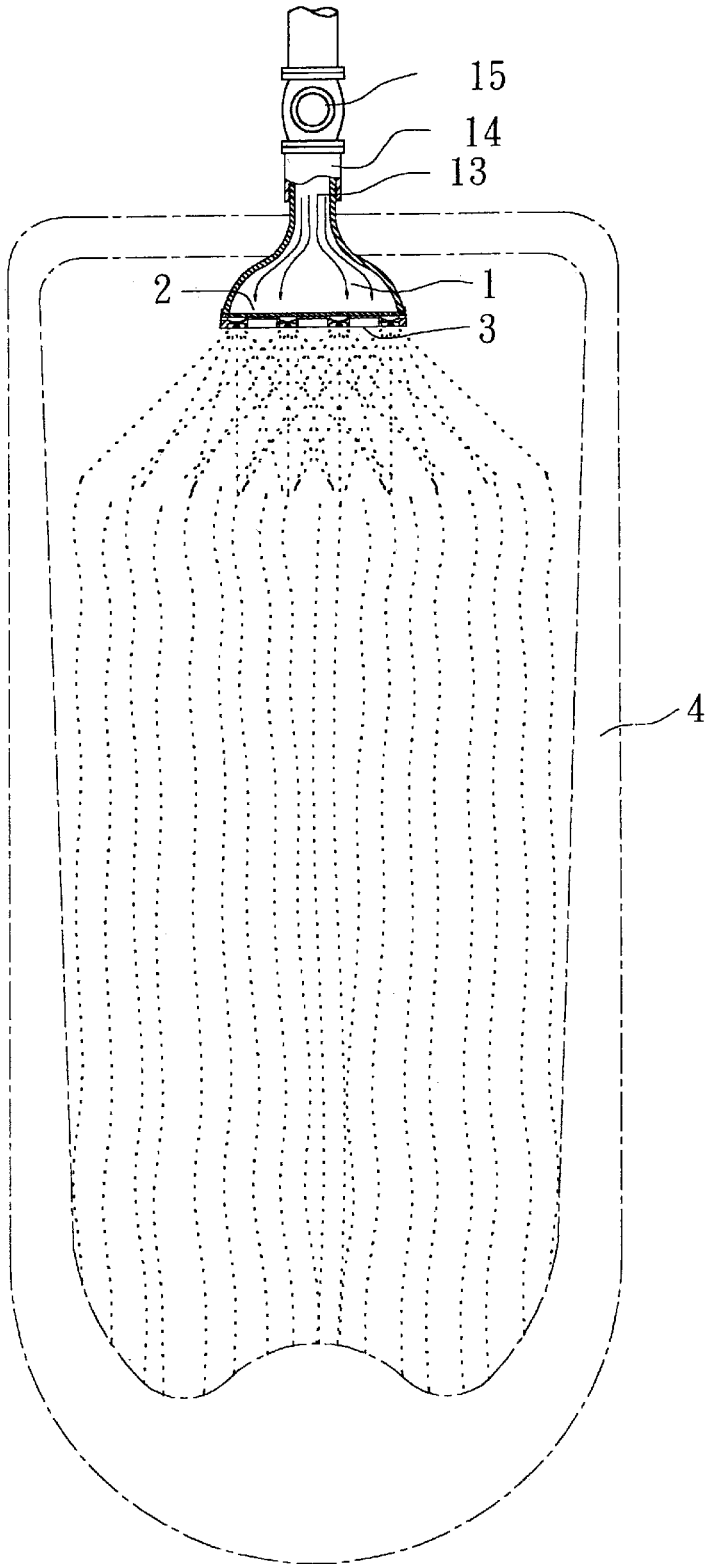
FIG. 5 is a second operational front plan view of the atomizer in FIG. 1.
Figure 6:
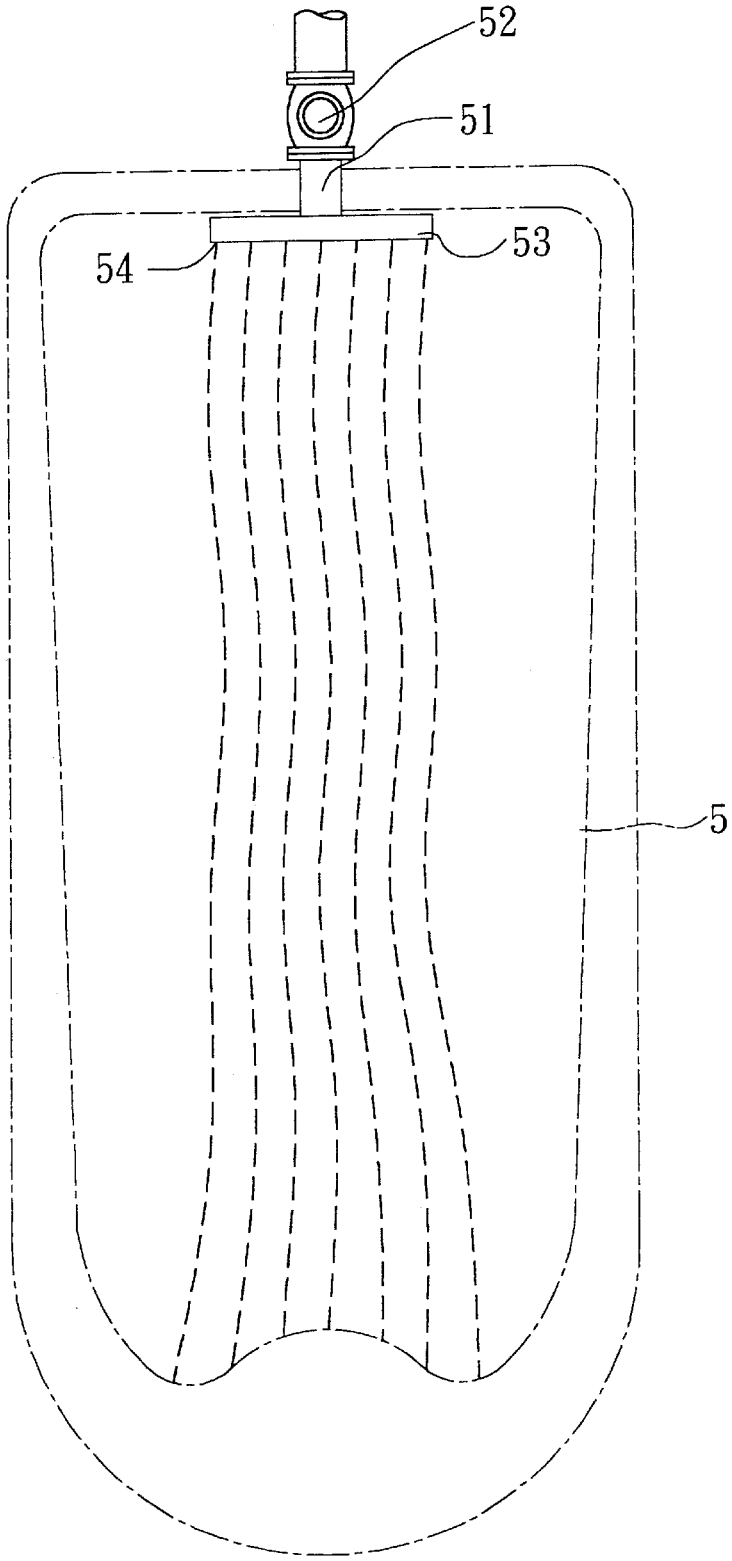
FIG. 6 PRIOR ART
FIG. 6 is an operational and schematic front plan view of a conventional atomizer in accordance with the prior art.

With reference to FIGS. 3–5, the atomizer in accordance with the present invention is adapted to be mounted on a top portion of a urinal. The atomized water is fully spread within the urinal. The spread area of the atomized water is greater than that of a spout such that the present invention provides an effect of water-saving, and the rate of the spreading speed of the atomized water is fast than that of the spout such that the atomized water from the present invention can quickly remove the peculiar smell after urinating.

Furthermore, the atomizer in accordance with the present invention can be used in several fields. In fire control, the atomized water from the atomizer can reduce the temperature of the environment. In gardening, the atomized water from the atomizer can sprinkle water to a great area and prevent the plants from being hurt due to a spout. In industry, the atomizer can be used as a moisture maker.

Although the invention has been explained in relation to its preferred embodiment, it is to be understood that many other possible modifications and variations can be made without departing from the spirit and scope of the invention as hereinafter claimed.

What is claimed is:

1. A atomizer comprising:

a plenum including an open first end having a diameter greater than that of a second end of the plenum, an inlet defined in the second end of the plenum, the inlet communicating with an inner periphery of the plenum and connected to a water source;

a sprayer attached to the open first end of the plenum for closing the plenum, the sprayer having multiple through holes defined therein and communicating with the inner periphery of the plenum; and an atomizing device securely attached to the sprayer opposite to the plenum, the atomizing device including multiple nozzles each co-axially aligning with a corresponding one of the multiple through holes in the sprayer, the nozzle including a skirt extending from the atomizing device and having an inner periphery, each nozzle having at least two awls laterally and radially extending from the inner periphery of each of the skirt to centrally define a passage that co-axially aligning with a corresponding one of the through hole in the sprayer.

2. The atomizer as claimed in claim 1, wherein the passage has a diameter smaller than that of the through hole in the sprayer such that the sprayer is atomized after flowing from the through hole in the sprayer and meeting a top end of each of the awls.

3. The atomizer as claimed in claim 1, wherein the nozzle includes a hole laterally defined in and extending through the skirt between the awls and the bottom of the sprayer to allow the air flowing into the skirt.

4. The atomizer as claimed in claim 1 further comprising an inlet hose having a first end connected to the inlet of the plenum and a second end connected to a water source, and a valve mounted on the inlet hose for selectively opening the inlet hose.

5. The atomizer as claimed in claim 2, wherein the nozzle includes a hole laterally defined in and extending through the skirt between the awls and the bottom of the sprayer to allow the air flowing into the skirt.

* * * * *